United States Patent [19]

Hubbard

[11] Patent Number: 4,529,624

[45] Date of Patent: Jul. 16, 1985

[54] DISCOLORATION RESISTANT HEAT TRANSFER LABELING

[75] Inventor: Karl E. Hubbard, South Grafton, Mass.

[73] Assignee: Dennison Manufacturing Co., Framingham, Mass.

[21] Appl. No.: 569,428

[22] Filed: Jan. 9, 1984

Related U.S. Application Data

[62] Division of Ser. No. 393,147, Jun. 28, 1982.

[51] Int. Cl.[3] ..... B41M 3/12; B05D 3/12

[52] U.S. Cl. ..... 427/148; 427/359; 427/407.1; 106/272

[58] Field of Search ..... 427/148, 359, 407.1; 106/272

[56] References Cited

U.S. PATENT DOCUMENTS

| | | | |
|---|---|---|---|
| 2,952,649 | 9/1960 | McCall et al. | 524/275 |
| 4,002,706 | 1/1977 | Pretorius | 524/487 |
| 4,235,657 | 11/1980 | Greenman | 428/484 |
| 4,404,249 | 9/1983 | Margerum | 428/484 |

*Primary Examiner*—Theodore Morris

*Attorney, Agent, or Firm*—George E. Kersey; Barry D. Josephs

[57] ABSTRACT

Product and process for heat transfer labeling employing a release layer that is resistant to discoloration, cracking and crawling. The release layer is formed by a blend of oxidized and unoxidized polyethylenes in proportions that prevent objectionable discoloration and hold a superimposed design in situ in order to relieve stresses that could otherwise produce cracking and crawling during heat transfer labeling. Viscosity can be suitably controlled by the addition of a minority amount of paraffin.

11 Claims, 8 Drawing Figures

DISCOLORATION RESISTANT HEAT TRANSFER LABELING

This is a division of Ser. No. 393,147, filed June 28, 1982.

BACKGROUND OF THE INVENTION

The invention relates to the labeling of objects by the use of heat to transfer designs from a carrier and, more particularly, to labeling which is resistant to objectionable discoloration, cracking and crawling during the heat transfer process.

In heat transfer labeling a design in a transfer layer is brought into contact with the object to be labeled. The transfer layer is usually held on a carrier by a release layer. When heat is applied to the carrier, the release layer becomes molten and releases the transfer layer and the accompanying design.

In the case of some heat transfer labels, such as those exemplified by U.S. Pat. No. 3,516,904, which issued to John J. Klinker on June 23, 1970, the release layer is of oxidized polyethylene. This kind of release layer is objectionable because it produces discolored, i.e., yellowed, heat transfer decorations. The transferred decorations also tend to be "hazy".

In other cases, such as exemplified by U.S. Pat. No. 3,516,842, which also issued to John J. Klinker et al. on June 23, 1970, the release layer can be of unoxidized polyethylene or a blend of ethyl-vinyl acetate copolymer and paraffin wax. The release layer produces objectionable cracking and crawling.

The cracking and crawling are caused by the differential expansion that takes place between an underlying wax-like release layer and an overlying design print in a transfer layer. When the two layers expand unevenly upon heating, they tend to separate from one another by forming ridges or corrugations where portions of one layer have separated from an adjoining layer. The result is a set of pressure ridges that break when stress is relieved. The resulting transferred label is unsightly and generally unsatisfactory.

Accordingly, it is an object of the invention to reduce discoloration in crawl and crackage resistant release layers.

Another object of the invention is to reduce the amount of haziness and cloudiness that often accompanies the use of synthetic wax-like materials in transfer layers.

SUMMARY OF THE INVENTION

In accomplishing the foregoing and related objects, the invention provides a heat transfer release composition formed by a mixture of oxidized and unoxidized polyethylenes. The release composition contains a major amount of unoxidized polyethylene and a minor amount of oxidized polyethylene.

In accordance with one aspect of the invention, a minor amount of paraffin can be added to help control viscosity and enhance print adhesion. It has been discovered that paraffin, which taken alone has an undesirable crawl and crackage resistant characteristic for release compositions, can nevertheless be used in low concentrations with a blend of oxidized and unoxidized polyethylenes to control viscosity and enhance print adhesion, without introducing the undesirable crawl and crackage characteristics that are found when paraffin is used alone, or in high concentrations.

In accordance with another aspect of the invention, it has been discovered that a polyethylene blend in accordance with the invention produces a reduced amount of haze and cloudiness in the transfer decoration. This reduction in haze and cloudiness surprisingly is not significantly diminished by the addition of a minor amount of paraffin in the blend in order to control viscosity or print adhesion.

In accordance with still another aspect of the invention, it has been discovered that it is possible to reduce the tendency of wax-like materials to crawl or fissure, and simultaneously prevent discoloration and haze, by using a major amount of unoxidized polyethylene and a minor amount of oxidized polyethylene. To economize on the amount of oxidized and unoxidized polyethylenes it is possible to add a minor amount of paraffin. This is desirable, but not essential, in helping to control low viscosity and also promote print adhesion by its low melting point characteristic.

DESCRIPTION OF THE DRAWINGS

Other aspects of the invention will become apparent after consideration of several illustrative embodiments taken in conjunction with the drawings in which.

DETAILED DESCRIPTION

Figure 1A:
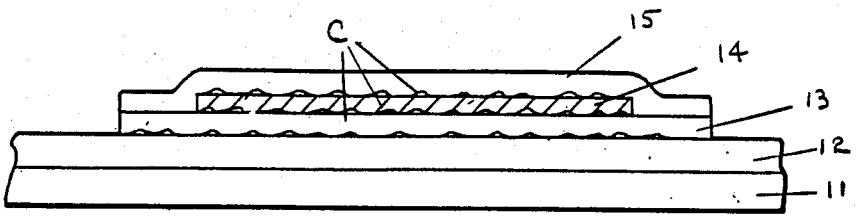
FIGS. 1A and 1B are sectional views of a heat transfer label of the prior art.
Figure 1B:
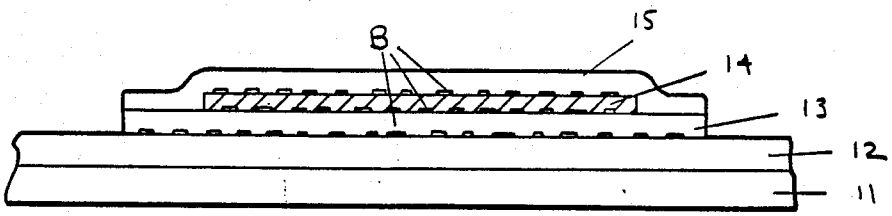

With reference to FIGS. 1A and 1B of the drawings, a carrier 11 in accordance with the prior art is provided with a release coating 12 upon which is superimposed a protective layer 13 and a transfer layer 14 which includes a design print. Overlying the transfer layer 14 is an adhesive layer 15.

When the transfer layer 14 and the adhesive layer 15 of the carrier 11 are together brought into contact with an object to be labeled, and heat is applied, the release coating 12 softens or melts and allows the contacting portion of the adhesive, transfer, and protective laminate 15, 14, 13 to be relesed to the container. Distortion produced by heating causes corrugations or cracking C of FIG. 1A which can become crackage, blisters or bubbles B in FIG. 1B. The corrugations C and crackage B present an objectionable appearance.

Figure 2A:
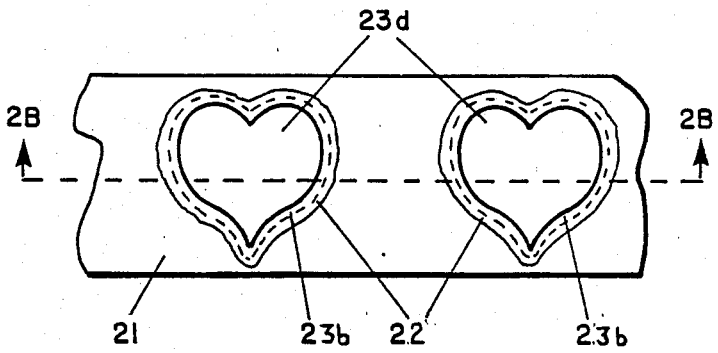
FIG. 2A is a plan view of a carrier with heat transfer labels in accordance with the invention.
Figure 2B:
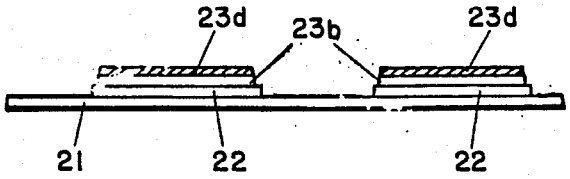
FIG 2B is a sectional view of FIG. 2A.
Figure 2C:
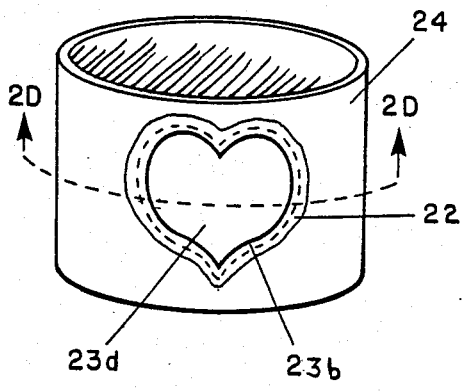
FIG. 2C is a perspective view of an object that has been labeled using the labels of FIG. 2A.
Figure 2D:
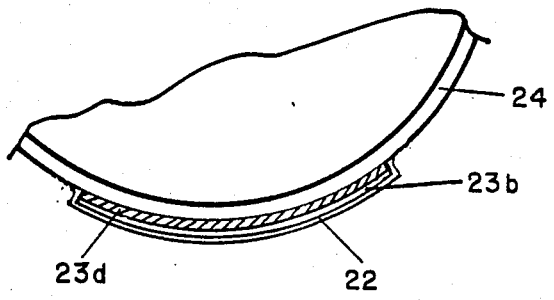
FIG. 2D is a sectional view of the object of FIG. 2C.

To remedy the foregoing difficulties, the invention provides heat transfer labeling arrangement as shown in FIGS. 2A and 2B in which a contoured release layer 22, formed from a mixture of unoxidized and oxidized polyethylenes is applied to a carrier 21. The contoured release layer 22 underlies a barrier or protective layer **23*b* and a transfer layer containing a design print 23*d*, which has adhesive properties. As a result, when the transfer layer 23*d* is brought into contact with an object to be labeled, such as the illustrative container 24 of FIG. 2C, the transferred design print 23*d* has superimposed on it a release layer 22 which provides a contoured halo with a narrow margin. In addition the barrier layer 23*b* also provides a margin with respect to the transferred design print 23***d*. In the particular embodiment of FIG. 2A, the margin for the barrier layer 23*b* extends beyond that of the design print layer 23*d*. This serves to seal the design print 23*d* and increase the mechanical and abrasive resistance of the decoration. In those cases where product resistance is not a significant consideration, the barrier layer 23*b* can be co-extensive with the design print, as can the release layer 22. In other cases the barrier layer can be omitted.

In the particular embodiment of FIGS. 2A and 2B the margin of the barrier over the design print is insufficient to cause any release difficulty. In cases where the margin of the barrier begins to pose a hindrance to release, the barrier margin can be reduced and even be made co-extensive with that of the release layer 22. Moreover, while it is desirable for the release layer 22 to be larger than the design print 23*d*, these two layers may also be co-extensive.

As seen in FIG. 2B, the barrier 23*b* provides suitable isolation between the ink layer of the design print 23*d* and the release layer 22 at the heat transfer temperature.

Figure 3A:
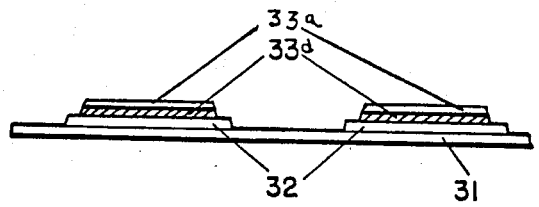
FIG. 3A is a sectional view of an alternative heat transfer label in accordance with the invention.

Under circumstances where the barrier layer may be omitted, for example, where the inks imprinted on the release layer are of barrier layer material, as indicated in the embodiment of FIG. 3A, a design print layer 33*d* and an adhesive layer 33*a* are directly superimposed on a release layer 32. The barrier can be omitted, for example, where the product being labled does not have an adverse effect upon the resultant label, or where the design print layer is immiscible with the release layer at heat transfer temperatures.

Figure 3B:
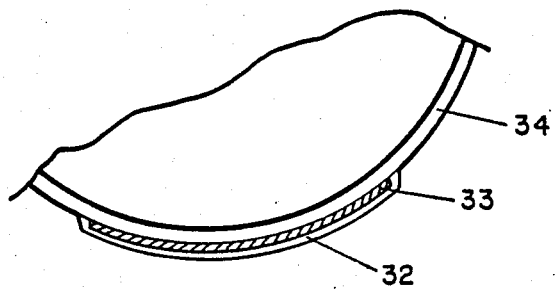
FIG. 3B is a sectional view of an object that has been labeled using the carrier of the alternative heat transfer label of FIG. 3A.

When the embodiment of FIG. 3A is used to decorate a container, with the result shown in FIG. 3B, the wall 34 of the illustrative container has superimposed on its external surface only two layers, namely a transfer layer 33 containing the desired design print 33*d* and the adhesive layer 33*a*, and a release layer 32. Bothe the transfer layer 33 and the release layer 32 are molten at heat transfer temperatures. In all cases where the transfer layer is insufficiently adhered, a further adhesive layer may be employed.

Suitable barrier lacquers may include aromatic, acid-based polyesters, acrylic resins, in particular polyacrylates and polymethacrylates cellulose esters, polyvinylidene chloride, acrylonitrile/vinylidene chloride copolymers, and vinyl acetate/vinyl chloride copolymers.

EXAMPLE I

A hot melt is prepared by mixing 15 parts by weight of a highly refined paraffin wax, such as Sunoco 5512, with 77 parts by weight of a low-molecular weight, non-emulsifiable unoxidized polyethylene, such as Allied Chemical A-C 20, and adding 8 parts of a low-molecular weight, emulsifiable oxidized polyethylene, such as Allied Chemical A-C 629.

The paraffin is initially introduced by itself into a "melting" tank. Once the paraffin is melted (after approximatiely 1½ hours), an agitator associated with the tank is started and the unoxidized polyethylene is added. The melting continues until completed (approximately 6 hours more). The oxidized polyethylene is then added. Melting continues until a homogeneous, substantially colorless hot melt is produced.

The hot melt is then applied to a carrier, typically a 32-pound sheet by a coater, e.g., reverse roll or slit orifice type. The coating weight is 3 to 4 pounds per 22"×25"×500" sheet ream, producing a thickness of approximately 0.4 to 0.6 mils. The release layer carrier combination is applied to a chill roll to help solidify the release layer. The chill roll is maintained at approximately room temperature (60° F. to 70° F.) The design is then printed using standard polyamide-nitrocellulose or polyacrylic inks and dried by solvent evaporation at about 250° F. in an oven. The final step is to apply a standardized polyamide-nitrocellulose or polyacrylic adhesive. This is dried at 250° F.

The resultant heat transfer laminate is next used in the decoration of plastic containers; for example polyethylene or polyvinylchloride using a standard Therimage® label decorator of the kind disclosed in U.S. Pat. Nos. 2,874,499; 2,981,432; 3,058,514; 3,064,714; 3,079,979, 3,111,446; 3,113,904; 3,139,368; 3,193,211; 3,208,897; 3,231,448; 3,261,734; 3,313,667; Re. 26,226; 3,483,063; 3,524,786; 3,540,968; 3,709,755; 3,712,449; 3,741,373; 3,823,218; 3,844,866; 3,861,984; 4,000,690.

The final transfer decoration does not have an objectionable discoloration and is crawl and crackage resistant.

EXAMPLE II

Example I is repeated except that the highly refined paraffin wax is omitted and the amount of oxidized polyethylene is increased to 10 parts by weight. The resulting decoration has greater crawl and crackage resistance but also a higher viscosity and higher melting point. The decoration consequently is not as easy to apply to a container.

EXAMPLE III

Example II is repeated except that the amount of oxidized polyethylene is increased to 15 parts by weight. The result is substantially the same as for Example II, but is slightly yellow: the overall visual appearance is unobjectionable.

EXAMPLE IV

Example I is repeated except that the highly refined paraffin wax is Moore and Munger 7356, which has a slightly lower melting point (149° F.–150° F.) than Sunoco 5512 (155° F.–158° F.). The results are substantially the same as for Example I.

EXAMPLE V

Example I and II are repeated except that the non-emulsified polyethylene is Allied Chemical A-C 617, which has a higher softening point (W-302-TW at 102° C.) as opposed to Allied Chemical A-C 20, which has a softening point (W-302-TW at 100° C.). Allied Chemical A-C 617 also has a higher molecular weight (approximately 1500) as opposed to 1400 for Allied Chemical A-C 20, greater hardness (8–12 dmm at 25° C.) for Allied Chemical A-C 20, as opposed to 6–9 dmm at 25° C. for Allied Chemical A-C 617. The viscosity for Allied Chemical A-C 20 is 110–130 cps at 140° C. and for Allied Chemical A-C 617 the viscosity is 180 cps at 140° C. The results are substantially the same as for Examples I and II.

EXAMPLE VI

Examples I and II are repeated except that the emulsifiable polyethylene is Allied Chemical A-C 655 and Allied Chemical A-C 656. A-C 655 has a higher softening point (107° C.) and a greater hardness (2.5) than A-C 20. A-C 656 has a lower softening point (100° C.) and is softer (9) than A-C 20. The results are substantially the same as for Examples I and II.

EXAMPLE VII

Examples I and II are repeated except that the release coating is applied by printing using a heated fountain, cylinder, pump, and holding reservoir. The results are substantially the same as for Examples I and II.

EXAMPLE VIII

Examples I and II are repeated except that a barrier layer is included between the release layer and the transfer layer. The results are substantially the same as for Examples I and II except that the labels have greater abrasion and product resistance.

EXAMPLE IX

Examples I and II are repeated except that the adhesive layer is omitted. The results are substantially the same as for Example I and II except that the adhesion of the label is not as great.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

I claim:

1. The method of preparing a heat transfer release composition comprising the steps of:

(1) melting a minority amount of paraffin;

(2) adding an unoxidized polyethylene to the melted paraffin and agitating the combination of the unoxidized polyethylene and paraffin until the melting of the polyethylene is complete;

(3) adding oxidized polyethylene and continuing the melting until a homogeneous, substantially colorless hot melt is produced;

(4) applying the hot melt to a carrier.

2. The method of claim 1 wherein said oxidized polyethylene is present in an amount up to 10 percent by weight of the composition.

3. The method of claim 1 wherein said oxidized polyethylene ethylene is at least 5 percent by weight of the composition.

4. The method of claim 1 wherein said unoxidized polyethylene is present in an amount up to 90 percent by weight of the composition.

5. The method of claim 1 wherein said unoxidized polyethylene is at least 70 percent by weight of the composition.

6. The method of claim 2 wherein said oxidized polyethylene has a softening point in the range between 100° C. and 107° C.

7. The method of claim 1 wherein said unoxidized polyethylene has a viscosity in the range from about 110 cps to about 180 cps at 140° C.

8. The method of claim 1 wherein said unoxidized polyethylene is non-emulsifiable.

9. The method of claim 1 further including the step of applying the release layer-carrier combination to a chill roll to help solidify the release layer.

10. The method of claim 9 further including the step of imprinting the release layer-carrier combination with polyamide-cellulose or polyacrylic inks.

11. The method of claim 10 including the step of applying a polyamide-nitrocellulose or polyacrylic adhesive to the design print.

* * * * *